US010835799B2

(12) United States Patent
Monk et al.

(10) Patent No.: US 10,835,799 B2
(45) Date of Patent: Nov. 17, 2020

(54) COVER FOR HAND-HELD PAD USED FOR HITTING, PUNCHING, OR KICKING

(71) Applicant: Grujmatch.com, LLC, Basking Ridge, NJ (US)

(72) Inventors: Catherine Perron Monk, Basking Ridge, NJ (US); Kathleen Susan Douville, Hudson, NH (US)

(73) Assignee: Grujmatch.com, LLC, Basking Ridge, NJ (US)

( * ) Notice: Subject to any disclaimer, the term of this patent is extended or adjusted under 35 U.S.C. 154(b) by 0 days.

(21) Appl. No.: 16/238,748

(22) Filed: Jan. 3, 2019

(65) Prior Publication Data

US 2019/0209907 A1 Jul. 11, 2019

Related U.S. Application Data

(60) Provisional application No. 62/709,043, filed on Jan. 5, 2018.

(51) Int. Cl.

| | |
|---|---|
| ***A63B 69/20*** | (2006.01) |
| ***A63B 69/00*** | (2006.01) |
| *B43L 1/00* | (2006.01) |

(52) U.S. Cl.

CPC ..... *A63B 69/20* (2013.01); *A63B 69/004* (2013.01); *A63B 2209/00* (2013.01); *A63B 2244/102* (2013.01)

(58) Field of Classification Search

CPC ..... A63B 69/004; A63B 69/20; A63B 69/24; A63B 69/26; A63B 69/32; A63B 69/325;

(Continued)

(56) References Cited

U.S. PATENT DOCUMENTS 961,149 A * 6/1910 Maynard ..... A63B 71/145 2/18

1,210,892 A 1/1917 Borchmann (Continued)

FOREIGN PATENT DOCUMENTS

JP 3023354 B2 3/2000
JP 3740344 B2 2/2006

OTHER PUBLICATIONS

Moreno, How to block punches in boxing [online], Published Jun. 15, 2017, [retrieved on Mar. 17, 2020]. Retrieved from the Internet <URL: https://www.youtube.com/watch?v=WEcv_JI85D8 > (Year: 2017).*

(Continued)

*Primary Examiner* — Garrett K Atkinson
*Assistant Examiner* — Zachary T Moore
(74) *Attorney, Agent, or Firm* — Mendelsohn Dunleavy, P.C.; Steve Mendelsohn

(57) ABSTRACT

A cover for a hand-held pad having one or two handles, the cover having interconnected panels that define one or more openings for inserting the pad into the cover and for providing access to the handle(s). In one embodiment, a punch pad has a glove portion, and the cover has a single opening for both inserting the pad into the cover and providing access to the pad glove. In another embodiment, the pad is a kickboxing pad having a hand grip and an arm band, and the pad has three openings: a first for inserting the pad into the cover, a second for accessing the hand grip, and a third for accessing the arm band. The panels are made suitable materials that enable the cover to fit snuggly over the pad where the front panel may be printed or written upon to display an image.

16 Claims, 12 Drawing Sheets

(58) Field of Classification Search
CPC ..... A63B 2209/00; A63B 2209/02; A63B 2209/023; A63B 2209/026; A63B 2244/102; A63B 2244/104; A63B 2244/106; A63B 2244/108; A63B 71/14; A63B 71/145; A41D 13/08; A41D 13/081; A41D 13/082; A41D 13/084; A47C 9/00; A47C 9/002; A47C 9/007
USPC ..... 482/83–90
See application file for complete search history.

(56) References Cited

U.S. PATENT DOCUMENTS 4,603,439 A * 8/1986 Golomb ..... A63B 71/145 2/18
4,667,343 A * 5/1987 Bettis ..... A63B 71/145 2/161.1
5,195,917 A 3/1993 Russell et al.
5,564,122 A * 10/1996 Wagner ..... A63B 71/143 2/16
2004/0003638 A1 1/2004 Schaefer et al.
2013/0007937 A1* 1/2013 Stone ..... A41D 13/081 2/16
2015/0057132 A1* 2/2015 Pedone ..... A63B 69/004 482/83
2017/0001091 A1* 1/2017 Holmes ..... A63B 69/26
2018/0093153 A1* 4/2018 Muhammad ..... A63B 69/20

OTHER PUBLICATIONS

Heddels, Know Your Terminology: Overlock Stitch vs. Flat-Felled Seam [online], Published Apr. 10, 2014, [retrieved on Mar. 10, 2020]. Retrieved from the Internet <URL: https://www.heddels.com/2014/04/know-terminology-overlock-stitch-vs-flat-felled-seam/> (Year: 2014).*
Ed Branigan, How to Print on Stretch Fabrics [online], published Dec. 5, 2011 [retrieved on Mar. 17, 2020]. Retrieved from the Internet < URL: https://printwearmag.com/features/how-print-stretch-fabrics > (Year: 2011).*

* cited by examiner

100

100

600

600

COVER FOR HAND-HELD PAD USED FOR HITTING, PUNCHING, OR KICKING

CROSS-REFERENCE TO RELATED APPLICATIONS

This application claims the benefit of the filing date of U.S. provisional application No. 62/709,043, filed on Jan. 5, 2018, the teachings of which are incorporated herein by reference in their entirety.

BACKGROUND

Field of the Invention

The present invention relates to a variety of hand-held pads used for the practice of hitting, punching, and/or kicking, such as a punch pad or a kickboxing pad.

Description of the Related Art

This section introduces aspects that may help facilitate a better understanding of the invention. Accordingly, the statements of this section are to be read in this light and are not to be understood as admissions about what is prior art or what is not prior art.

Combat sports, including but not limited to boxing, Mixed Martial Arts (MMA), Kickboxing, Tae Kwon Do, Judo, Karate, Muay Thai, have been growing in popularity among young people and the older generation in recent years. The increased participation in these combat sports has as much to do with stress relief or anger management offered by combat sports activities as it does with the general fitness benefits they offer.

While a smaller proportion of the participants in combat sports choose to become competitive athletes with advanced training to develop speed, power, and accuracy in their hitting, punching, and kicking techniques, all combat sports participants benefit from training. To this end, equipment designed to aid the training and development of combat sports for all its participants has proliferated, and there is now a wide range of hand-held pads, of varying sizes, used for the practice of hitting, punching, and kicking.

Although the hand-held pads used in combat sports practice and training vary in size, they tend to fall into one of three shape categories—oval, pear, and rectangle—regardless of the manufacturer. All the hand-held pads, by nature of their purpose, have underlying padding often made of thick foam or felt-like material of sufficient thickness to prevent injury to the combat sports participants as well as to the individual holding the pad that is the object of the hit, punch, or kick. Such hand-held pads have permanent covers which are made of leather, synthetic leather, or material of similar look and durability which is tightly attached to the pads with some form of permanent stitching.

All such hand-held pads have significant shortcomings. The cost of replacing permanent covers is typically higher than simply purchasing new pads. Further, any attempts to replace permanent covers or reinstall removable covers over underlying padding often will significantly damage the underlying padding, thereby reducing the utility of the hand-held pads.

Indeed, such shortcomings are well recognized. Many combat sports equipment manufacturers have a limited warranty on the hand-held pads—the industry standard typically is 120 days due to the nature of use.

Some hand-held pads have the means, attached to the hand-held pad itself, for a person, other than the combat sports participant, to hold the pad for the benefit of the combat sports participant. For example, some oval and pear-shaped hand-held pads have a single permanent glove attachment, while the back of some rectangular hand-held pads have two permanent loop attachments of sufficient size so that a trainer or sparring partner may hold the pad with two hands or, alternatively, hold the pad with one arm by inserting a hand through one loop (e.g., an arm band) up to the forearm and grasping the other loop (e.g., a hand grip) with that same hand. These attachments, both glove and loops, provide the trainer or sparring partner more control and flexibility when holding the pads for hitting, punching, and kicking.

In addition to the glove/loop attachments, some hand-held pads may have a small circle or symbol or text on the front of the permanent cover which serves as a non-descript target for the combat sport participant or as indicia of the manufacturer of the hand-held pad. Such permanent covers lack visual cues designed to enhance the focus of the combat sports participant.

SUMMARY

In certain embodiments, the present invention is a cover for a hand-held pad comprised of one or more fabrics, such as vinyl knit, nylon, or compression fabric, which cover is advantageously durable, stretchable, snug to the form of the hand-held pad, and removable. The cover addresses the physical desirability of preserving the permanent covers of the hand-held pads by offering additional protection when used and does not require exposure of any underlying padding. The cover may further address the mental and emotional desirability of being personalized by having the target area on the front of the hand-held pad used for hitting, punching, and kicking display an image (possibly including text) that will focus the participant's attention.

BRIEF DESCRIPTION OF THE DRAWINGS

Embodiments of the invention will become more fully apparent from the following detailed description, the appended claims, and the accompanying drawings in which like reference numerals identify similar or identical elements.

DETAILED DESCRIPTION

Figure 1:
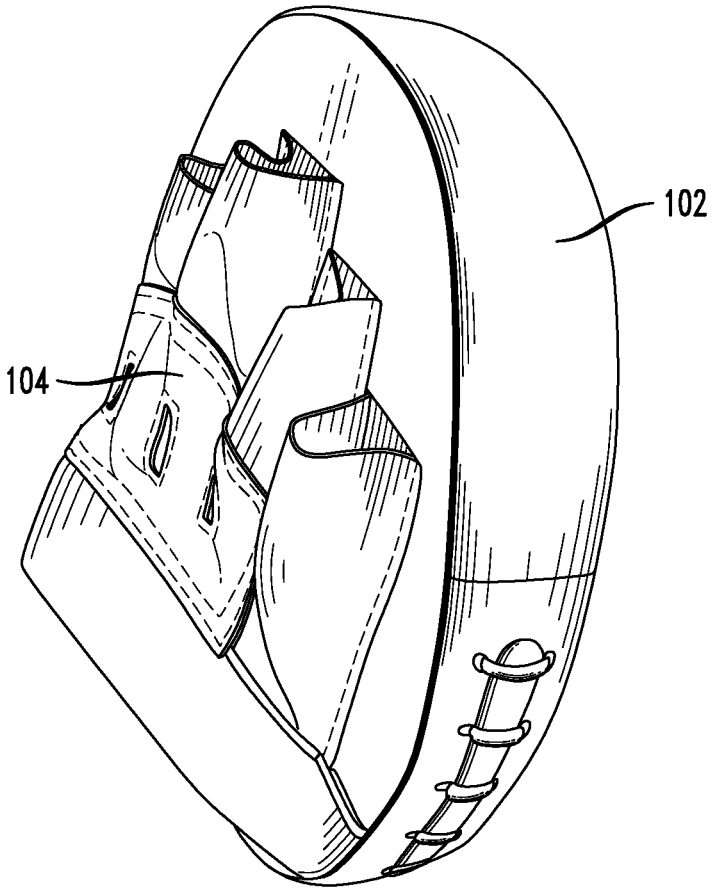
FIG. 1 PRIOR ART
FIG. 1 is a perspective back view of a conventional, hand-held, punch pad.

Detailed illustrative embodiments of the present invention are disclosed herein. However, specific structural and functional details disclosed herein are merely representative for purposes of describing example embodiments of the present invention. The present invention may be embodied in many alternate forms and should not be construed as limited to only the embodiments set forth herein. Further, the terminology used herein is for the purpose of describing particular embodiments only and is not intended to be limiting of example embodiments of the invention.

As used herein, the singular forms "a," "an," and "the," are intended to include the plural forms as well, unless the context clearly indicates otherwise. It further will be understood that the terms "comprises," "comprising," "includes," and/or "including," specify the presence of stated features, steps, or components, but do not preclude the presence or addition of one or more other features, steps, or components. It also should be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

The present invention relates to hand-held pads of various shapes used for the purpose of hitting, punching, and/or kicking. The present invention specifically relates to an additional, removable cover, which is used to provide further protection to the permanent cover and the underlying padding of a hand-held pad. The present invention also enables customized markings (such as symbols, pictures, text) on the front of the cover wherein such markings may serve as visual cues designed to enhance the focus of the combat sport's participant.

Regardless of the shape of the hand-held pad, in some embodiments, the cover is advantageously comprised of three or four pieces of fabric sewn together except for openings for glove/handle/loop attachments of the hand-held pad. In particular, one piece of fabric forms a front panel of the cover of a size approximating the front or hitting surface of the hand-held pad. Another piece of fabric, which forms a side panel of the cover, has four edges and approximately forms a parallelogram and which approximates the side area of the hand-held pad. One edge of the side panel is attached to the perimeter or edge of the front panel, and, in some embodiments, such edge is about the same length as the perimeter of the front panel so that the side panel completely surrounds the hand-held pad. The two edges of the side panel that form the other parallel sides are attached to each other to form a seam. The remaining edge of the side panel, roughly parallel to the edge attached to the front panel, is attached to a third piece of fabric that (i) forms the back panel of the cover and (ii) is attached to the side panel opposite the top of the front panel except that the bottom portion of the back panel is not sewn to the side panel so as to leave a gap through which a person may insert his or her hand to grip the loops or glove of the hand-held pad and through which the cover may be placed over the hand-held pad. In some embodiments, a fourth piece of fabric may also be used as part of the back panel of the cover. In such case, the fourth piece is attached to the side panel below the third piece except for the portion of the fourth piece opposite the third piece which remains unattached so as to maintain a gap through which a person may place his or her hand to grip the hand-held pad and through which the cover may be placed over the hand-held pad. The pieces are advantageously attached in the preferred embodiment using a form of permanent stitching using a straight stitch and an overlock stitch, although it is recognized that other means, as for example other forms of stitching or adhesives, may be used to attach the pieces.

In some embodiments, four pieces of fabric are used, although three pieces may be used to reduce costs or where the snugness of fit afforded using four pieces of fabric is not required, as, for example, when the cover is used for combat sport participants who are children and who would not be expected to hit, punch, or kick with the same amount of power as an adult.

A loop may be further attached to the cover. The loop may be made of an elastic material with the base of the loop attached (as for example by the same techniques used to attached the pieces of the cover) to the cover in a manner whereby the person holding the hand-held pad may insert one or two fingers of his or her hand through the loop prior to inserting that hand through the gap on the back portion of the cover which gap is used to enable the person to grip the loops or glove of the hand-held pad and through which the cover may be placed over the hand-held pad. The elastic loop advantageously provides an additional means of securing the cover when hit, punched, or kicked.

Two specific types of fabric are used in certain embodiments. Some embodiments use a first fabric, a vinyl knit of two layers (one layer being vinyl and the other a spandex knit) in which the composition of the fabric is a polyester-spandex blend of 85% to almost 100% polyester and 15% to almost 0% spandex with 95% polyester and 5% spandex being used in one particular embodiment. Other embodiments use a second fabric, a compression or performance fabric of a polyester-spandex blend of 80% to 95% polyester and 20% to 5% spandex with a fabric composition of 89% polyester and 11% spandex being used in one particular embodiment. Variations in the percentages of polyester and spandex in the first and second fabrics may be made to adapt the cover within a range of different characteristics, and combinations of fabrics may alternatively be used to form the cover. For example, an increased percentage of polyester may be used to create greater compression; alternatively, market conditions for fabric availability or fabric prices may influence the selection of fabrics to optimize costs. There is a tradeoff between the percentages of polyester and spandex. In general, increasing the percentage of spandex and decreasing the percentage of polyester increases the stretchability of the fabric, but decreases the compressive force applied by the fabric when stretched, and vice versa. The inventors have determined that a fabric composition of 89% polyester and 11% spandex provides sufficient stretchability to enable the pad to be inserted into the cover and sufficient compression to hold the cover in place when the pad is being used. Further, variations apart from polyester-spandex blends of vinyl knits and compression fabrics may also be considered so long as the fabric selection provides the requisite snugness of fit over the hand-held pads.

In some embodiments, the front panel of the cover provides a small amount of stretch in order to fit over and sit snugly on the hand-held pad, but not so much stretch so as to distort any image that may be displayed on the front panel, as for example by means of a hot press or by drawing on it with ink.

In some embodiments, the side panel and the back panel of the cover provide substantial compression in order to remain in place on the hand-held pad when hitting, punching, and kicking occurs. The compression allows for no or negligible displacement of the cover when in use. In some embodiments, a small strip of (e.g., silicone) gripping material is advantageously attached or sewn onto the inner surface of the side panel that increases the coefficient of friction between the cover and the hand-held pad to further secure and prevent the cover from slipping off the hand-held pad.

In certain embodiments, the material for the loop is an elastic fabric having a thickness of about 1/16" and a width of about 3/8", where the perimeter of the loop is about 5", which is the distance from the base of the loop (which is attached to the cover) to the base of the means by which the user grips the underlying hand-held pad. The length, size, and width of the loop is selected based on a number of factors including comfort of the holder of the hand-held pad, minimizing interference with the ease of putting on and removing the cover, and the degree of extra security desired in the fit of the cover.

In some embodiments, no rigid fasteners are used so as to eliminate any interference with the holding of the hand-held pads. The cover is intended to slip on and slip off with minimal effort, yet be secure.

In certain embodiments, the front panel of the cover may display an image. Current research in athlete preparation, in stress relief, and even in anger management suggests the use of visualization in focusing both attention and energy. By visualizing that which causes the stress, the anger, or the need for preparation (as in an opponent), an individual can attack the problem in a controlled environment using the hand-held pad and the interaction of a trainer or sparring partner. If an image is not to be heat transferred onto the front panel of the cover, then nylon may be substituted for polyester in the fabrics since nylon may be damaged by heat. Nylon could provide an even snugger fit. If an image is to be heat transferred, as for example by sublimation, to the fabric used for the front panel of the cover, then the front panel should not include a vinyl layer since vinyl is sensitive to heat. However, if an image is to be hand drawn on the front panel, then vinyl will be receptive to the ink used for the image.

Figure 2:
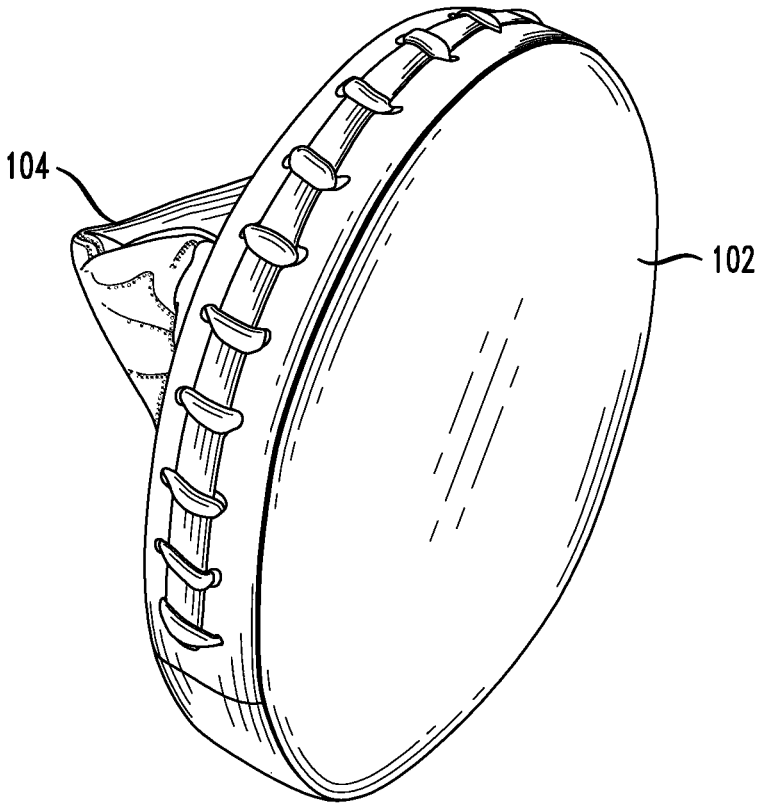
FIG. 2 PRIOR ART
FIG. 2 is a perspective front view of the punch pad of FIG. 1.

FIG. 1 is a perspective back view of a conventional, hand-held, punch pad 100, while FIG. 2 is a perspective front view of the punch pad 100 of FIG. 1. The punch pad 100 has a permanent cover 102 that encloses an inner padding (not shown). The punch pad 100 also has a glove portion 104 designed to receive a hand of the person holding the punch pad.

Figure 3:
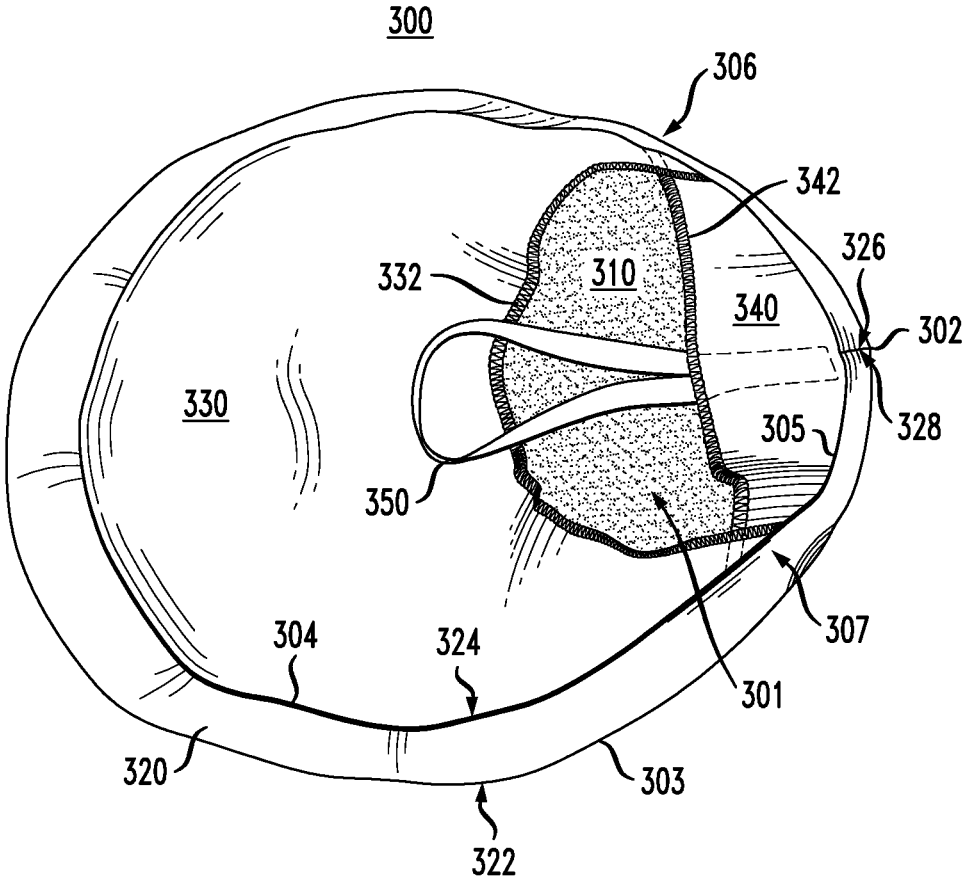
FIG. 3 is a perspective view of a cover for the punch pad of FIGS. 1 and 2, according to one embodiment of the invention.

FIG. 3 is a perspective view of a cover 300 for the punch pad 100 of FIGS. 1 and 2, according to one embodiment of the invention. The cover 300 is formed using four pieces of fabric that form (i) a substantially oval front panel 310, (ii) an irregular cylindrical side panel 320, (iii) a substantially scalloped oval top back panel 330, and a substantially circular segment-shaped bottom back panel 340. Note that, in the perspective view of FIG. 3, an inner surface of the front panel 310 is visible through the opening 301 in the cover 300 formed by the top and bottom back panels 330 and 340.

The substantially rectangular piece of fabric that forms the side panel 320 has two opposing long edges 322 and 324 and two opposing short edges 326 and 328. The two short edges 326 and 328 are sewn together at a seam 302 to give the side panel 320 its irregular cylindrical shape. The long edge 322 is sewn to the outer edge of the front panel 310 at a seam 303. A first part of the long edge 324 is sewn to the outer edge of the top back panel 330 to form a seam 304, while a second part of the long edge 324 is sewn to the outer edge of the bottom back panel 340 to form a seam 305. Note that the top back panel 330 overlaps the bottom back panel 340 at regions 306 and 307, such that parts of seam 304 coincide with corresponding parts of seam 305. In other embodiments (not shown), the bottom back panel 340 may overlap the top back panel 330, and, in still other embodiments (also not shown), the seams 304 and 305 might abut one another or there might even be a gap between them, such that there is no overlap between the top and bottom back panels 330 and 340.

The substantially scalloped edge 332 of the top back panel 330 and the substantially straight edge 342 of the bottom back panel 340 are not sewn to any other piece of fabric such that the opening 301 in the cover 300 is formed. Although the opening 301 of the (relaxed) cover 300 is smaller than the outer dimensions of the punch pad 100 of FIGS. 1 and 2, the side panel 320 and top and bottom back panels 330 and 340 are made of a suitable elastic material that enables the panels to be stretched to allow the punch pad 100 to be inserted into the cover 300 through the opening 301. The opening 301 also enables a person to access the glove 104 of the punch pad 100 inside the cover 300 in order to hold the punch pad.

Note that the panels 310-340 can be but do not all have to be made from the same material and that, depending on whether an image is to be applied to the front panel 310 using, for example, heat, certain materials that are suitable for the other three panels might not be suitable for the front panel 310. Note further that it is most important for one or both of the back panels 330 and 340 to be made of a sufficiently elastic material and least important for the front panel 310 to be made of a material with such elastic characteristics.

As shown in FIG. 3, the cover 300 also has an optional loop 350 made from a suitable elastic material and sewn onto the inner surface of the bottom back panel 340 (or alternatively onto the inner surface of the side panel 320). The loop 350 can receive one or more fingers of the person's hand that is inserted through the cover opening 301 into the glove 104 of the punch pad 100.

Figure 4:
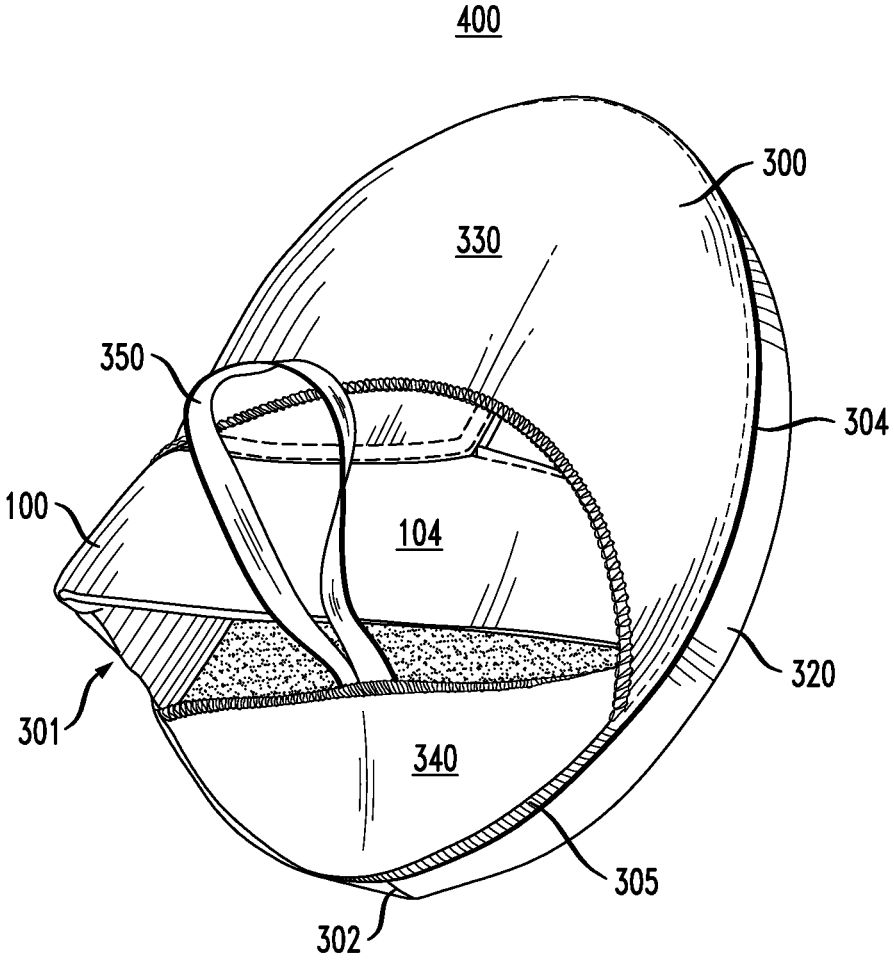
FIG. 4 is a perspective view of the back of a covered-pad assembly formed by inserting the punch pad of FIGS. 1 and 2 into the opening in the cover of FIG. 3.
Figure 5:
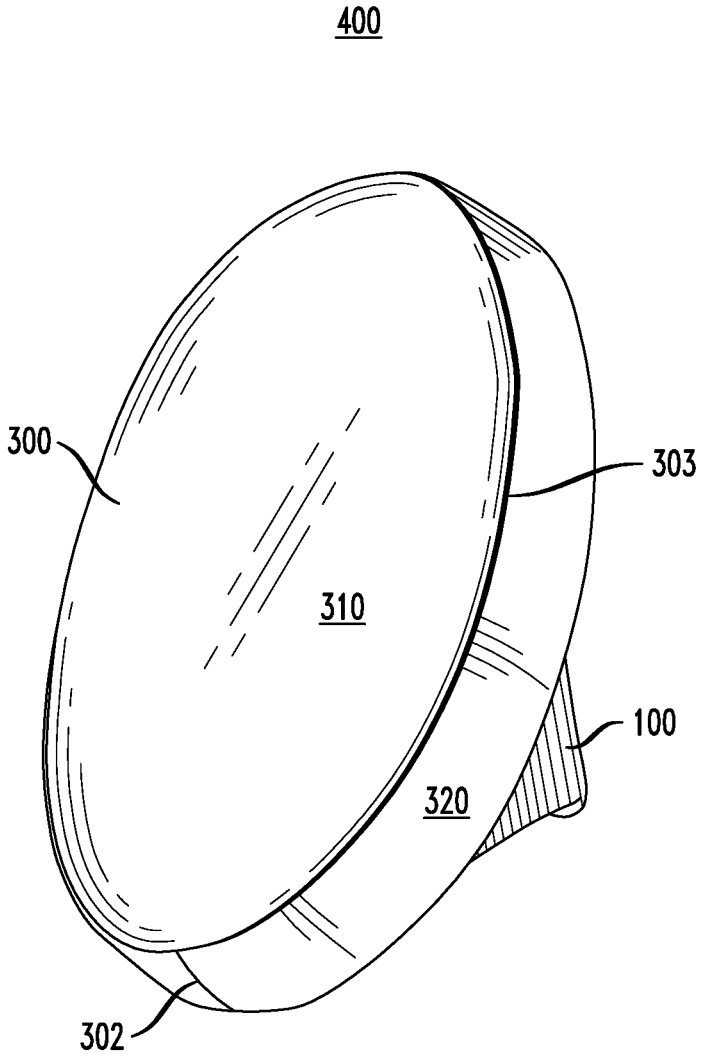
FIG. 5 is a perspective view of the front of the assembly of FIG. 4.

FIG. 4 is a perspective view of the back of a covered-pad assembly 400 formed by inserting the punch pad 100 of FIGS. 1 and 2 into the opening 301 in the cover 300 of FIG. 3, while FIG. 5 is a perspective view of the front of the assembly 400 of FIG. 4. Note that, although not shown in FIG. 5, the front panel 310 of the cover 300 may display an image.

Figure 6:
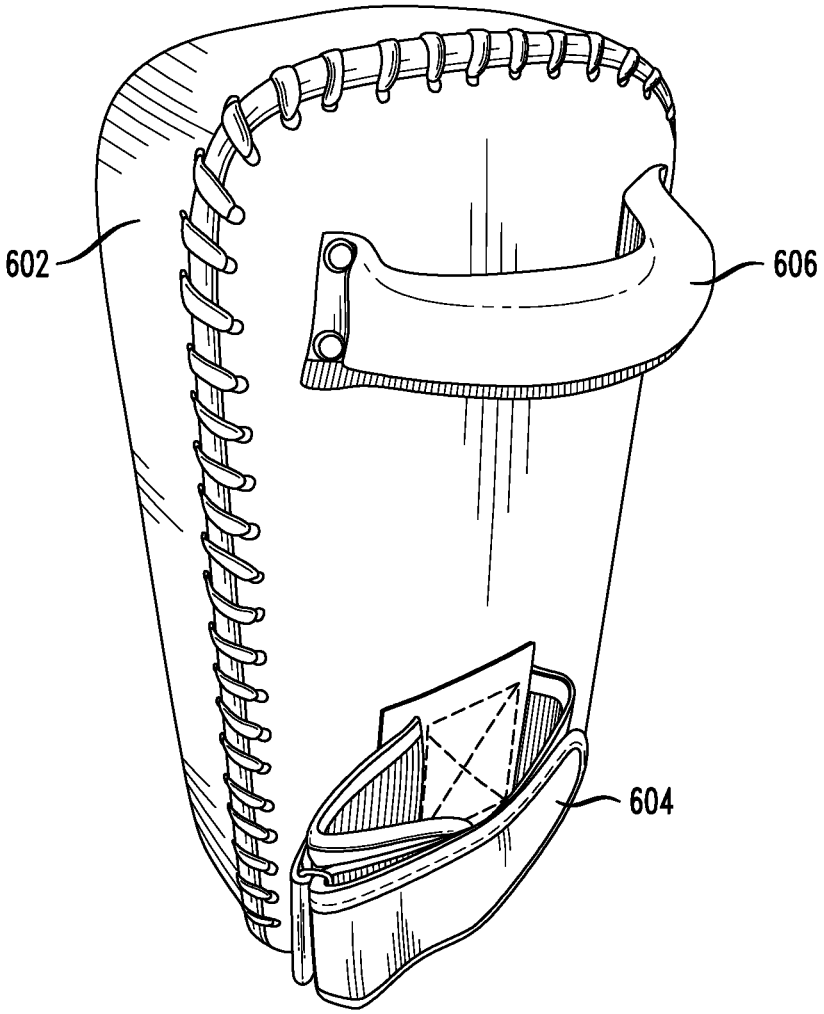
FIG. 6 PRIOR ART
FIG. 6 is a perspective back view of a conventional, hand-held, kickboxing pad.
Figure 7:
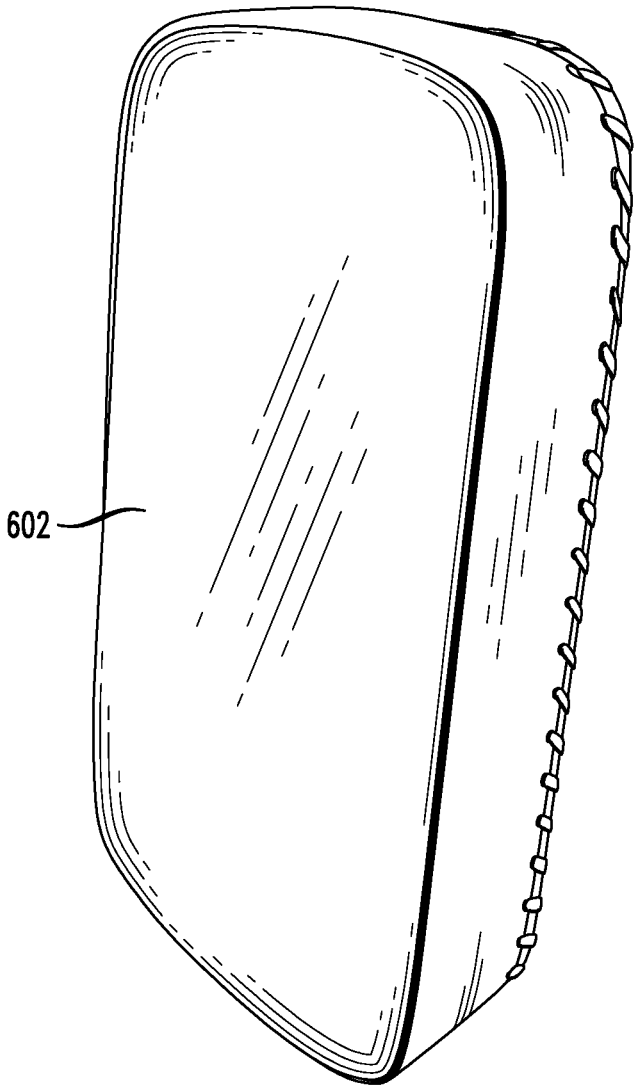
FIG. 7 PRIOR ART
FIG. 7 is a perspective front view of the kickboxing pad of FIG. 6.

FIG. 6 is a perspective back view of a conventional, hand-held, kickboxing pad 600, while FIG. 7 is a perspective front view of the kickboxing pad 600 of FIG. 6. The kickboxing pad 600 has a permanent cover 602 that encloses an inner padding (not shown). The kickboxing pad 600 also has an arm band 604 and a hand grip 606, where a person grips the hand grip 606 with his/her hand while the person's corresponding forearm is retained within the Velcro-fastened arm band 606.

Figure 8:
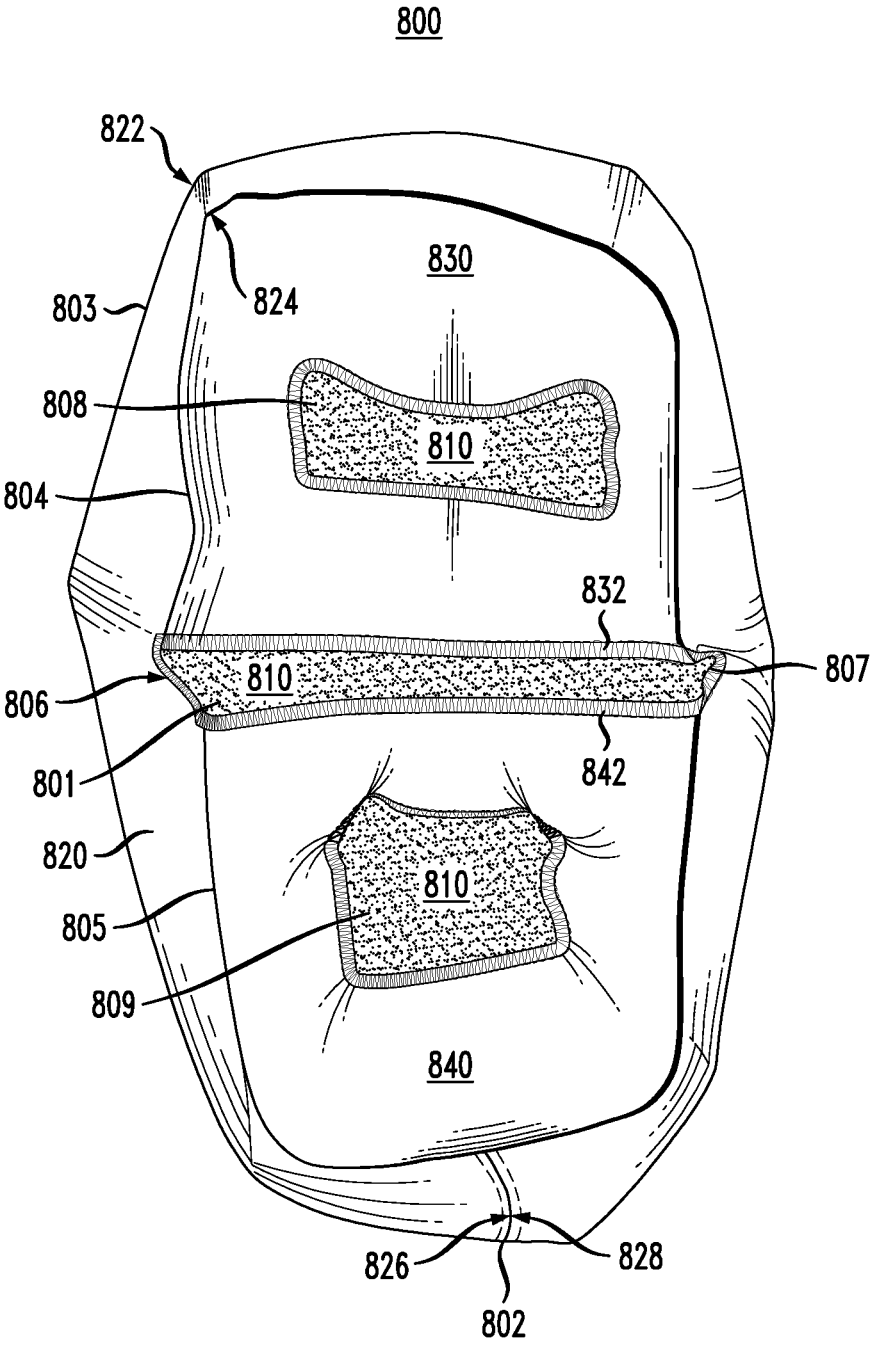
FIG. 8 is a perspective view of a cover for the kickboxing pad of FIGS. 6 and 7, according to another embodiment of the invention.

FIG. 8 is a perspective view of a cover 800 for the kickboxing pad 600 of FIGS. 6 and 7, according to another embodiment of the invention. The cover 800 is formed using four pieces of fabric that form (i) a substantially rectangular front panel 810, (ii) an irregular cylindrical side panel 820, (iii) a substantially rectangular top back panel 830 having an opening 808 for receiving the arm band 604 of the kickboxing pad 600, and a substantially rectangular bottom back panel 840 having an opening 809 for receiving the hand grip 606 of the kickboxing pad 600. Note that, in the perspective view of FIG. 8, an inner surface of the front panel 810 is visible through the opening 801 in the cover 800 between the top and bottom back panels 830 and 840 as well as through the openings 809 and 809 in the back panels 830 and 840, respectively.

The substantially rectangular piece of fabric that forms the side panel 820 has two opposing long edges 822 and 824 and two opposing short edges 826 and 828. The two short edges 826 and 828 are sewn together at a seam 802 to give the side panel 820 its irregular cylindrical shape. The long edge 822 is sewn to the outer edge of the front panel 810 at a seam 803. A first part of the long edge 824 is sewn to the outer edge of the top back panel 830 to form a seam 804, while a second part of the long edge 824 is sewn to the outer edge of the bottom back panel 840 to form a seam 805. Note that there are two gaps 806 and 807 between the seams 804 and 805 that form opposing sides of the rectangular opening 801 in the cover 800. The other two opposing sides of the rectangular opening 801 are formed by edges 832 and 842 of the back panels 830 and 840, respectively.

Although the opening 801 of the (relaxed) cover 800 is smaller than the outer dimensions of the kickboxing pad 600 of FIGS. 6 and 7, the side panel 820 and top and bottom back panels 830 and 840 are made of a suitable elastic material that enables the panels to be stretched to allow the kickboxing pad 600 to be inserted into the cover 800 through the opening 801.

Note that the panels 810-840 can be but do not all have to be made from the same material and that, depending on whether an image is to be applied to the front panel 810 using, for example, heat, certain materials that are suitable for the other three panels might not be suitable for the front panel 810. Note further that it is most important for one or both of the back panels 830 and 840 to be made of a sufficiently elastic material and least important for the front panel 810 to be made of a material with such elastic characteristics.

Figure 9:
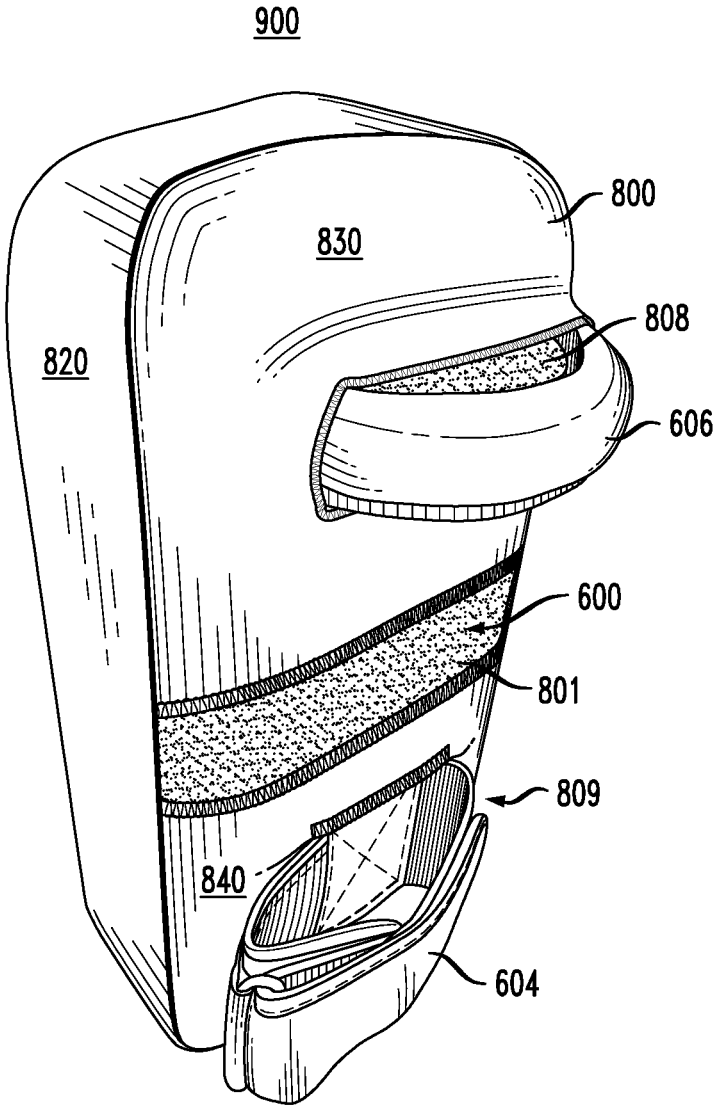
FIG. 9 is a perspective view of the back of a covered-pad assembly formed by inserting the kickboxing pad of FIGS. 6 and 7 into an opening in the cover of FIG. 8.
Figure 10:
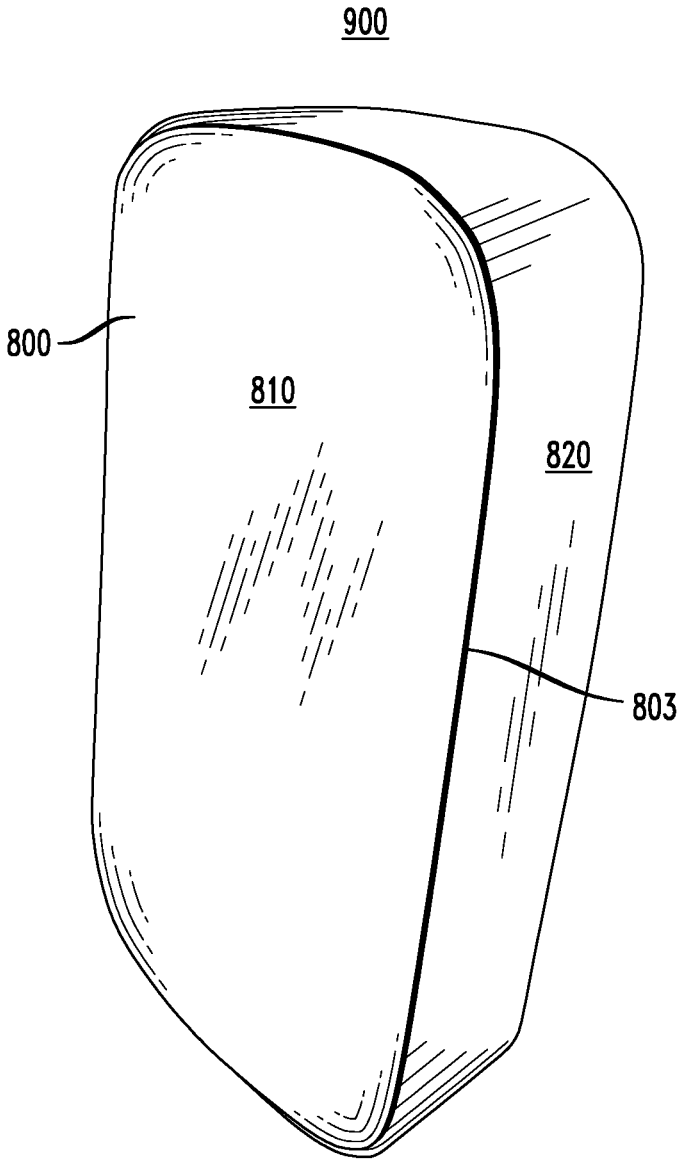
FIG. 10 is a perspective view of the front of the assembly of FIG. 9.

FIG. 9 is a perspective view of the back of a covered-pad assembly 900 formed by inserting the kickboxing pad 600 of FIGS. 6 and 7 into the opening 801 in the cover 800 of FIG. 8, while FIG. 10 is a perspective view of the front of the assembly 900 of FIG. 9. Note that, although not shown in FIG. 10, the front panel 810 of the cover 800 may display an image.

Figure 11:
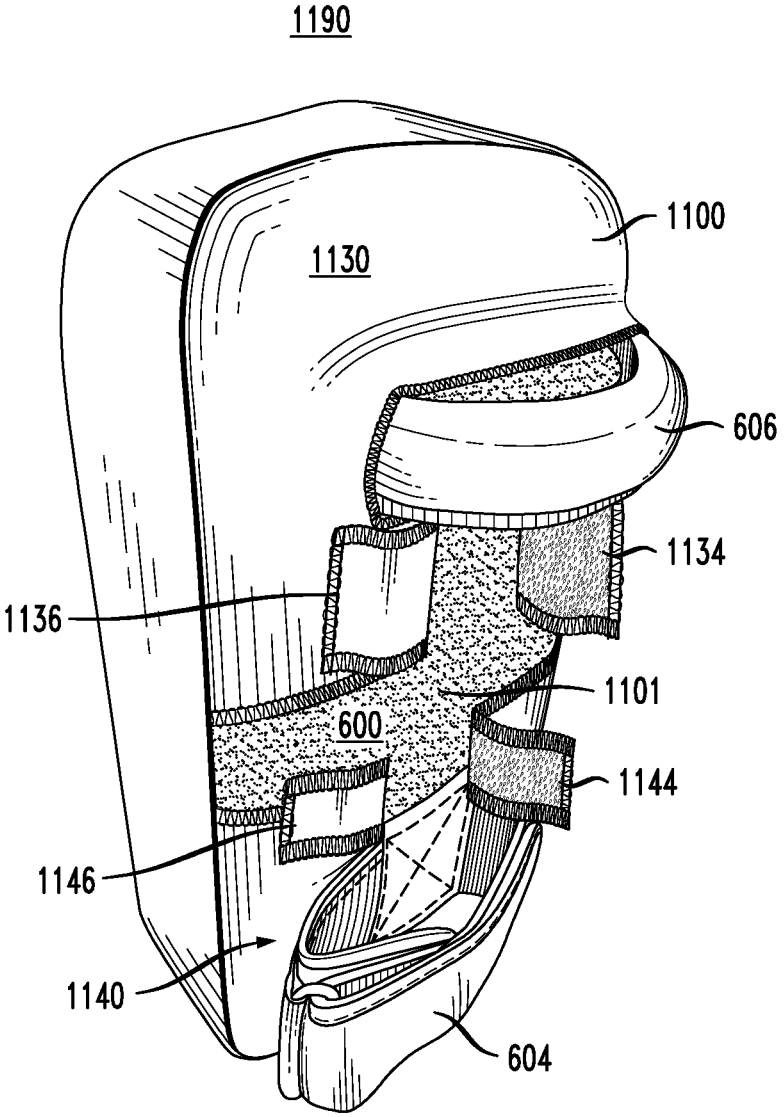
FIG. 11 is a perspective view of the back of a covered-pad assembly formed by inserting the kickboxing pad of FIGS. 6 and 7 into an opening in a cover according to another embodiment of the invention.

FIG. 11 is a perspective view of the back of a covered-pad assembly 1190 formed by inserting the kickboxing pad 600 of FIGS. 6 and 7 into the opening 1101 in a cover 1100 according to another embodiment of the invention. The cover 1100 is analogous to the cover 800 of FIG. 8, except that the top back panel 1130 has two corresponding Velcro straps 1134 and 1136 and the bottom back panel 1140 has two corresponding Velcro straps 1144 and 1146. As represented in FIG. 11, with the straps 1134, 1136, 1144, and 1146 unfastened, the opening 1101 in the cover is much bigger, thereby enabling even easier insertion of the kickboxing pad 600 into the cover 1100.

Figure 12:
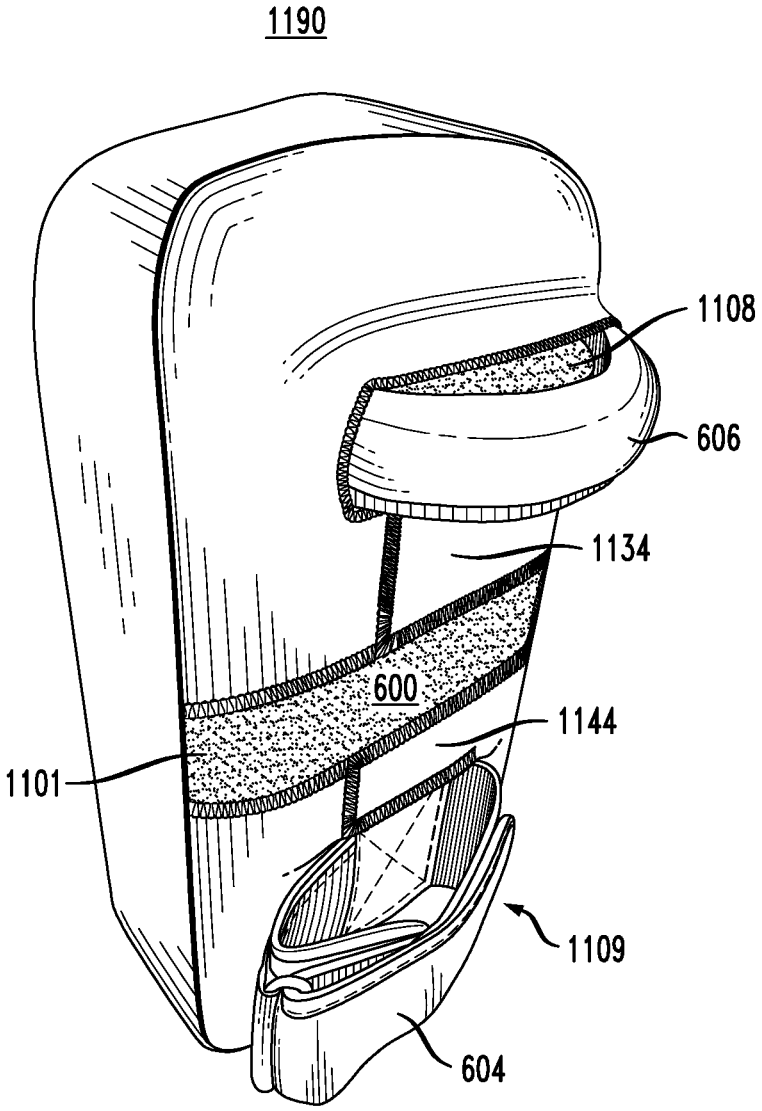
FIG. 12 is a perspective view of the back of the assembly of FIG. 11 with the straps fastened.

FIG. 12 is a perspective view of the back of the assembly 1190 with the strap 1134 fastened over and onto the strap 1136 (not shown) and the strap 1144 fastened over and onto the strap 1146 (not shown). In this configuration, the cover 1100 has three openings 1101, 1108, and 1109 that are analogous to the openings 801, 808, and 809 in the cover 800 of FIG. 8.

In general, in certain embodiments, the panels of the covers are sized to be sufficiently smaller than the corresponding dimensions of the received pad, and the materials used for those panels have sufficient elasticity such that the cover applies a sufficiently strong compressive force on the pad to keep the cover snuggly in place while the resulting covered-pad assembly is hit, punched, and/or kicked.

Although the invention has been described in the context of covers for the punch pad 100 of FIGS. 1 and 2 and the kickboxing pad 600 of FIGS. 6 and 7, those skilled in the art will understand that the invention can be implemented in the context of covers for other types of hitting, punching, and/or kicking pads, such as (without limitation) pear-shaped pads.

Although the invention has been described in the context of covers formed by sewing different pieces of fabric together to form the cover panels, those skilled in the art will understand that, in alternative embodiments, pieces of fabric may be held together using suitable techniques other than sewing, so long as they do not interfere with the stretchability of the cover. Note that the thread and/or the types of stitching used to sew the pieces of fabric together should also not interfere with the stretchability of the cover. In certain embodiments, polyester thread and overlock stitching are used to achieve the desired stretchability.

Although the invention has been described in the context of covers formed using four pieces of fabric, in alternative embodiments, covers can be formed using more or fewer than four pieces of fabric. For example, a cover analogous to the cover 300 of FIG. 3 can be formed using only three pieces of fabric by omitting the bottom back panel 340. As another example, a cover analogous to the cover 1100 of FIG. 11 can be formed using only three pieces of fabric by substituting a single piece of fabric having a single pair of relatively wide, Velcro straps for the top and bottom back panels 1130 and 1140. Such a cover would have only two openings analogous to the openings 1108 and 1109. Although these embodiments have been described as having Velcro straps, those still in the art will understand that other suitable types of releasable connections may be used instead of Velcro.

In certain embodiments, provided is a cover (e.g., 300, 800, 1100) for a hand-held pad (e.g., 100, 600), the hand-held pad having at least one handle (e.g., 104, 604/606) for holding the hand-held pad, the cover comprising a plurality of interconnected panels (e.g., 310-340, 810-840) that define a cover interior, wherein the cover has one or more openings (e.g., 301, 801/808/809, 1101/1108/1109) configured for inserting the hand-held pad into the cover interior and for providing manual access to the at least one handle. In certain embodiments of the foregoing, the plurality of interconnected panels comprises a side panel (e.g., 320, 820) having a front edge (e.g., 322, 822) and a back edge (e.g., 324, 824); a front panel (e.g., 310, 810) having an outer edge, wherein the outer edge of the front panel is connected to the front edge of the side panel; a top back panel (e.g., 330, 830, 1130) having an outer edge, wherein a first portion of the outer edge of the top back panel is connected to a first portion of the back edge of the side panel and a second portion of the outer edge of the top back panel is not connected to the back edge of the side panel; and a bottom back panel (e.g., 340, 840, 1140) having an outer edge, wherein a first portion of the outer edge of the bottom back panel is connected to a second portion of the back edge of the side panel and a second portion of the outer edge of the bottom back panel is not connected to the back edge of the side panel, such that the second portion of the top back panel and the second portion of the bottom back panel define a first opening (e.g., 301, 801, 1101) in the cover configured for inserting the hand-held pad into the cover interior.

In certain embodiments of the foregoing, the side panel is formed from a substantially rectangular piece of material having two relatively long edges (e.g., 322/324, 822/824) and two relatively short edges (e.g., 326/328, 826/828), wherein the two relatively short edges are interconnected to provide the side panel with an irregular cylindrical shape.

In certain embodiments of the foregoing, the hand-held pad is a punch pad (e.g., 100) having a glove portion (e.g., 104) as the handle; the first opening (e.g., 301) is the only opening in the cover; and the first opening is configured to provide access to the glove portion of the hand-held pad when located within the cover.

In certain embodiments of the foregoing, the first portion of the outer edge of the top back panel overlaps the first portion of the outer edge of the bottom back panel at two sides (e.g., 306/307) of the first opening.

In certain embodiments of the foregoing, a finger loop (e.g., 350) connected to the bottom back panel and configured to receive one or more fingers of a user's hand when inserted through the first opening into the glove portion of the hand-held pad.

In certain embodiments of the foregoing, the finger loop is made of a resilient elastic material.

In certain embodiments of the foregoing, the top back panel is formed from a piece of fabric having a substantially scalloped oval shape; and the bottom back panel is formed from a piece of fabric having a substantially circular segment shape.

In certain embodiments of the foregoing, the hand-held pad is a kickboxing pad (e.g., 600) having (i) a hand grip (e.g., 606) as the handle and (ii) an arm band (e.g., 604) for retaining a user's forearm; the top back panel is configured to define a second opening (e.g., 808) in the cover through which the hand grip extends from the cover interior when the kickboxing pad is located within the cover; and the bottom back panel is configured to define a third opening (e.g., 809) in the cover through which the arm band extends from the cover interior when the kickboxing pad is located within the cover.

In certain embodiments of the foregoing, at least one of (i) the top back panel has a releasable connection (e.g., 1134/1136) that defines the second opening in the cover; and (ii) the bottom back panel has a releasable connection (e.g., 1144/1146) that defines the third opening in the cover.

In certain embodiments of the foregoing, the top back panel is formed from a piece of fabric having a substantially rectangular outer shape; and the bottom back panel is formed from a piece of fabric having a substantially rectangular outer shape.

In certain embodiments of the foregoing, the side panel, the top back panel, and the bottom back panel are formed from a resilient elastic fabric.

In certain embodiments of the foregoing, the resilient elastic fabric is a polyester spandex fabric.

In certain embodiments of the foregoing, the front panel is formed from a printable fabric.

In certain embodiments of the foregoing, the front panel is formed from the resilient elastic fabric.

In certain embodiments of the foregoing, the front panel is formed from an erasable writable fabric.

In certain embodiments of the foregoing, the front panel is formed from a vinyl material.

In certain embodiments of the foregoing, the interconnected panels are stitched together.

In certain embodiments of the foregoing, the interconnected panels are stitched together using overlock stitching.

In certain embodiments of the foregoing, provided is a method for protecting the hand-held pad, the method comprising (i) inserting the hand-held pad into the cover via an opening in the cover to form a covered-pad assembly; (ii) holding the covered-pad assembly by accessing at least one handle of the hand-held pad through at least one corresponding opening in the cover; and (iii) receiving at least one of hits, punches, and kicks to the held, covered-pad assembly.

Unless explicitly stated otherwise, each numerical value and range should be interpreted as being approximate as if the word "about" or "approximately" preceded the value or range.

It will be further understood that various changes in the details, materials, and arrangements of the parts which have been described and illustrated in order to explain embodiments of this invention may be made by those skilled in the art without departing from embodiments of the invention encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

All documents mentioned herein are hereby incorporated by reference in their entirety or alternatively to provide the disclosure for which they were specifically relied upon.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

Unless otherwise specified herein, the use of the ordinal adjectives "first," "second," "third," etc., to refer to an object of a plurality of like objects merely indicates that different instances of such like objects are being referred to, and is not intended to imply that the like objects so referred-to have to be in a corresponding order or sequence, either temporally, spatially, in ranking, or in any other manner.

What is claimed is:

1. A cover for a hand-held pad, the hand-held pad having at least one handle for holding the hand-held pad, the cover comprising a plurality of interconnected panels that define a cover interior, wherein the cover has one or more openings configured for inserting the hand-held pad into the cover interior and for providing manual access to the at least one handle, wherein the plurality of interconnected panels comprises:

a side panel having a front edge and a back edge;

a front panel having an outer edge, wherein the outer edge of the front panel is directly connected to the front edge of the side panel;

a top back panel having an outer edge, wherein a first portion of the outer edge of the top back panel is directly connected to a first portion of the back edge of the side panel and a second portion of the outer edge of the top back panel is spaced apart from the back edge of the side panel; and a bottom back panel having an outer edge, wherein a first portion of the outer edge of the bottom back panel is directly connected to a second portion of the back edge of the side panel and a second portion of the outer edge of the bottom back panel is spaced apart from the back edge of the side panel, such that the second portion of the top back panel and the second portion of the bottom back panel define a first opening in the cover configured for inserting the hand-held pad into the cover interior.

2. The cover of claim 1, wherein the side panel is formed from a substantially rectangular piece of material having two relatively long edges and two relatively short edges, wherein the two relatively short edges are directly interconnected to provide the side panel with an irregular cylindrical shape.

3. The cover of claim 1, wherein:

the hand-held pad is a punch pad having a glove portion as the handle;

the first opening is the only opening in the cover; and the first opening is configured to provide access to the glove portion of the hand-held pad when located within the cover.

4. The cover of claim 3, wherein the first portion of the outer edge of the top back panel overlaps the first portion of the outer edge of the bottom back panel at two sides of the first opening without being directly connected to the first portion of the outer edge of the bottom back panel in the overlap regions.

5. The cover of claim 3, further comprising a finger loop connected to the bottom back panel and configured to receive one or more fingers of a user's hand when inserted through the first opening into the glove portion of the hand-held pad, wherein the finger loop provides a second opening for receiving the one or more fingers that is independent of the first opening.

6. The cover of claim 5, wherein the finger loop is made of a resilient elastic material.

7. The cover of claim 3, wherein:

the top back panel is formed from a piece of fabric having a substantially oval shape with a substantially circular segment shaped portion removed; and the bottom back panel is formed from a piece of fabric having a substantially circular segment shape.

8. The cover of claim 1, wherein the side panel, the top back panel, and the bottom back panel are formed from a resilient elastic fabric.

9. The cover of claim 8, wherein the resilient elastic fabric is a polyester spandex fabric.

10. The cover of claim 8, wherein the front panel is formed from a printable fabric.

11. The cover of claim 10, wherein the front panel is formed from the resilient elastic fabric.

12. The cover of claim 8, wherein the front panel is formed from an erasable writable fabric.

13. The cover of claim 12, wherein the front panel is formed from a vinyl material.

14. The cover of claim 1, wherein the interconnected panels are stitched together.

15. The cover of claim 14, wherein the interconnected panels are stitched together using overlock stitching.

16. A method for protecting the hand-held pad of claim 1, the method comprising:

inserting the hand-held pad into the cover of claim 1 via an opening in the cover to form a covered-pad assembly;

holding the covered-pad assembly by accessing the at least one handle of the hand-held pad through the at least one corresponding opening in the cover; and receiving at least one of hits, punches, and kicks to the held, covered-pad assembly.

* * * * *